United States Patent [19]

Bachner

[11] 4,234,036

[45] Nov. 18, 1980

[54] ARRANGEMENT AT A CONTINUOUS CASTING PLANT

[75] Inventor: Ernst Bachner, Linz, Austria

[73] Assignee: Voest-Alpine Aktiengesellschaft, Linz, Austria

[21] Appl. No.: 59,066

[22] Filed: Jul. 19, 1979

[30] Foreign Application Priority Data

Aug. 4, 1978 [AT] Austria ..... 5671/78

[51] Int. Cl.[3] ..... B22D 11/10

[52] U.S. Cl. ..... 164/420; 164/437; 222/600

[58] Field of Search ..... 164/337, 420, 437, 438; 222/541, 600

[56] References Cited

U.S. PATENT DOCUMENTS 977,271 11/1910 Callaghan ..... 222/600

2,218,171 10/1940 Junghans ..... 164/420

2,770,856 11/1956 Becker et al. ..... 222/541 X

*Primary Examiner*—Robert D. Baldwin

*Attorney, Agent, or Firm*—Brumbaugh, Graves, Donohue & Raymond

[57] ABSTRACT

In an arrangement at a continuous casting plant including at least two mold cavities, a common distributing vessel for supplying melt into each mold cavity through an outflow opening that is closeable by means of a stopper, via a casting pipe reaching from the distributing vessel to the mold cavity, a shearing means including a shearing head and a sealing plate following upon the shearing head is provided. The shearing means is movable by an adjustment drive from a waiting position beside the casting pipe into a closing position covering the outflow opening by the sealing plate, on simultaneous shearing off of the part of the casting pipe projecting at the outer side of the distributing vessel, by the shearing head.

5 Claims, 3 Drawing Figures

ARRANGEMENT AT A CONTINUOUS CASTING PLANT

The invention relates to an arrangement at a continuous casting plant comprising two or more mould cavities supplied with melt from a common distributing vessel, the melt flowing from the distributing vessel into each mould cavity through one outflow opening each that is closeable by means of a stopper, and through a casting pipe reaching from the distributing vessel into the mould cavity.

With distributing vessels for multiple-strand continuous casting plants, the amount of melt emerging from the distributing vessel and flowing into the mould can be precisely controlled by adjusting different distances of the stopper from the outflow opening. The stoppers are simple and cheap to produce and relatively safe in operation when used.

It may however happen that the stopper closure and thus the regulation of the amount of melt fail, if for instance the stopper rod or the pouring brick show greater signs of wear, due to erosion. Cracks may furthermore occur at the casting pipe usually inserted in the pouring brick, caused by thermal shocks, which cracks freqently propagate to the interior of the distributing vessel as far as to the upper end of the casting pipe, sealing of the outflow opening and control of the flowing out melt by means of the stopper thus not being possible any longer.

With such a "leaky stopper," in order to avoid overrunning of the mould concerned, casting hitherto has had to be interrupted at all moulds, i.e. also at those not immediately concerned by a leaky stopper, and the distributing vessel has had to be moved out of the casting position for renewal of the damaged part.

The invention aims at avoiding these disadvantages and has as its object to provide an arrangement that makes possible that casting has to be interrupted, on the occurrence of a leaky stopper, only at those mould cavities whose allocated stoppers and casting pipes have been damaged, and casting at the other mould cavities whose allocated casting pipes and stoppers are still intact can be maintained without interruption of casting.

These objects are achieved according to the invention by a shearing means provided at each casting pipe on the outer side of the distributing vessel and comprising a shearing head and a sealing plate following upon the shearing head, wherein the shearing means is movable by means of an adjustment drive from a waiting position beside the casting pipe into a closing position covering the outflow opening by means of the sealing plate upon simultaneous shearing off of the part of the casting pipe projecting at the outer side of the tundish by means of the shearing head.

Advantageously, the shearing head is made of metal, preferably of steel, and the sealing plate is made of a refractory material.

A preferred embodiment is characterized in that, as the adjustment drive, a pressure-medium cylinder including a pressure-medium storing container fastened to the tundish for receiving a pressure medium being under pressure, is provided.

A further suitable embodiment is characterized in that, as the adjustment drive, a spring pressing the shearing arrangement from the waiting position into the closing position is provided, which spring can be released by means of an actuation device from the tensioned state in the waiting position.

The invention will now be explained in more detail by way of two embodiments illustrated in the accompanying drawings, wherein.

Figure 1:
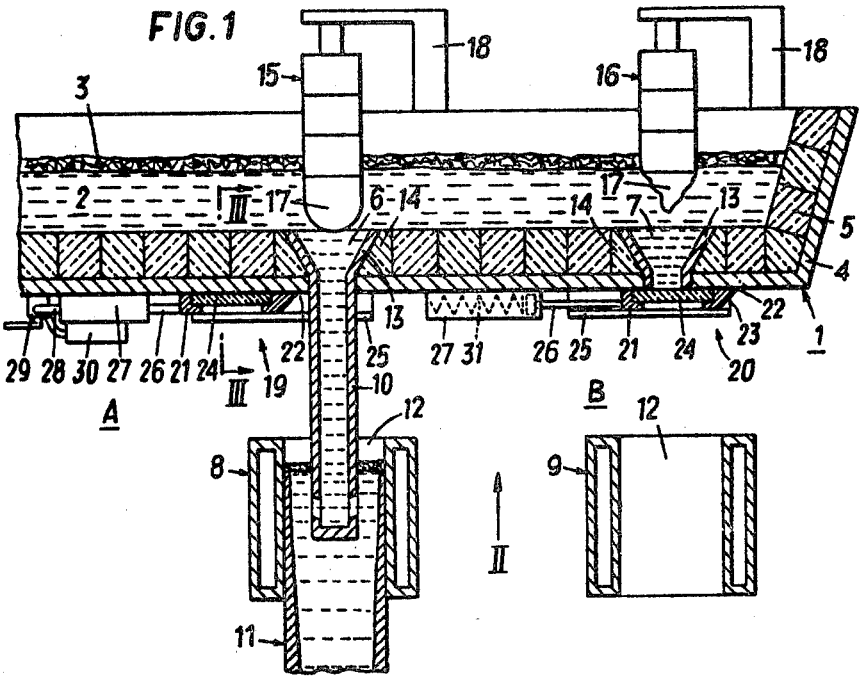
FIG. 1 illustrates a section through a schematically represented continuous casting plant for steel in which two strands are cast.
Figure 2:
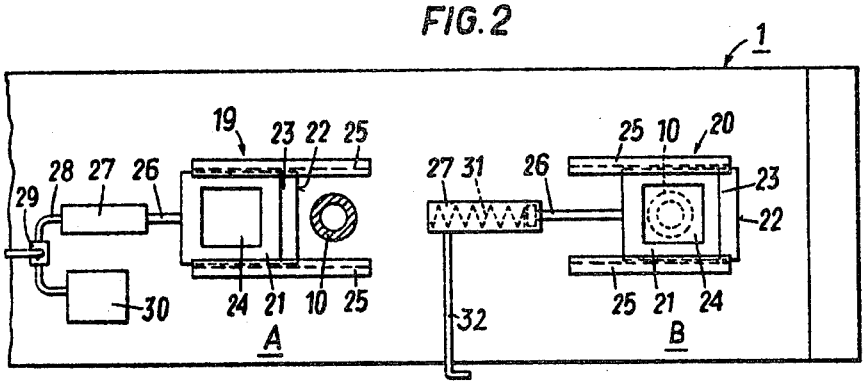
FIG. 2 shows a view of the distributing vessel in the direction of the arrow II of FIG. 1.
Figure 3:
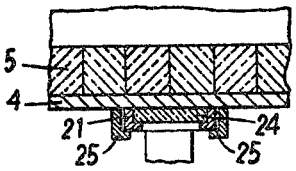
FIG. 3 is a sectional representation according to a section laid along line III—III of FIG. 1.

A distributing vessel containing steel melt 2 flowing in from a casting ladle not illustrated and covered by a slag layer 3 is denoted by 1. The bottom plate and the side walls of the distributing vessel consist of a steel plate 4 at the outer side and a lining 5 of refractory material arranged at the inner side. The distributing vessel 1 includes two outflow openings 6 and 7 through which, during normal operation, the steel melt 2 flows via casting pipes 10 inserted in the outflow openings and each projecting down to the cavities 12 of continuous casting moulds 8 and 9. In the embodiment illustrated, two moulds 8, 9, arranged one beside the other, are provided; instead of these moulds 8, 9, it is also possible to use a single, broad mould whose cavity is subdivided by separating walls into several smaller cavities arranged one beside the other. Below the moulds 8, 9, strand guiding means not illustrated, for supporting and guiding the strand 11 emerging from the mould, are provided.

The casting pipe 10, at its upper end, includes a conically widened part 13 with which it is inserted in a pouring brick 14 comprising a corresponding conical face. For closing the outflow openings 6, 7 and for controlling the steel melt flowing out through these outflow openings, one stopper 15, 16 each serves, which, at its lower end, comprises a semi-spherically shaped brick 17, the so-called stopper crown. Schematically illustrated lifting devices 18 serve for adjusting the height of the stoppers.

At the outer side of the bottom of the distributing vessel, a shearing means 19, 20 is mounted at each casting pipe 10. Each shearing means comprises a frame part 21 made of steel whose front end is designed as a shearing head 23 including a cutting edge 22. A sealing plate 24 of refractory material is each inserted in this frame part 21.

The shearing means 19 and 20 can be moved with the help of an adjustment drive drivable by any suitable means, from a waiting position A beside the casting pipe, which in FIG. 1 is illustrated in the left part of the figure for the shearing means 19, into a closing position B covering the outflow opening 6 and 7, respectively, by means of a sealing plate 24, which is illustrated in the right part of FIG. 1 for the shearing means 20.

According to the embodiment of the shearing means 19, a piston fastened on the frame part 21 serves for displacement, which piston is inserted in a pressure-medium cylinder 27. For supplying the pressure-medium cylinder 27 with pressure medium, the pressure medium cylinder is connected in a conduit-like manner with a pressure-medium storing container 30, via a pressure-medium conduit 28 in which a faucet 29 is incorporated. The pressure-medium storing container 30 is also mounted at the outer side of the bottom of the distributing vessel. This has the advantage that no conduits whatsoever need be led from a stationary pressure-medium supply station to the pressure-medium cylinder 27, the full movability of the distributing vessel thus being retained. As a pressure medium, gas or also a liquid may be used.

The shearing means denoted by 20 comprises a cylinder 27 in whose interior a pressure spring 31 is installed, which presses the piston 26 into its end position illustrated in FIG. 1, in which the sealing plate 24 covers the outflow opening 7. In the waiting position A of the shearing means 20, the piston can be fixed by means of a hand lever 32 in the cylinder, with the spring 31 pressed together. For displacing the shearing means, also any other driving means, for instance an electromotor, can be utilized.

The arrangement functions in the following way:

If, for instance, the stopper crown 17 has been worn, as is for instance illustrated in the right part of FIG. 1 for the stopper 16, the shearing means 19 and 20, respectively, is set in motion in the direction towards the casting pipe, by pulling the hand level 32 or by opening the faucet 29, the part of the casting pipe 10 that projects at the bottom outer side of the distributing vessel being sheared off by the shearing head 23. The exit of steel melt through the outflow opening is thereby interrupted, as this is illustrated in FIG. 1 for the outflow opening 7. Possible untight spots resulting from a play between the shearing means and the guiding rails are automatically sealed by the freezing (solidifying) of steel melt at the sealing plate. The shearing means can thus be produced very cheaply and with great tolerances. It also need be movable in only one direction, i.e. towards the casting pipe, by means of an adjustment drive. Positioning back of the shearing means into the waiting position can be effected on simultaneously tensioning the spring 31 and refilling the pressure-medium storing container 30, with the distributing vessel having been brought into the repair position. The casting pipe falling into the liquid strand core when separated, is suitably removed by nippers.

As can be seen in FIG. 1, it is possible with the help of the shearing means to partly maintain casting in order to be able to finish casting of at least one charge being in the casting ladle or in the distributor vessel. From the mould 9, which is not supplied any longer with melt, due to the interruption in the melt supply, the strand is extracted in the meantime.

What I claim is:

1. In an arrangement at a continuous casting plant of the type including at least two mould cavities, a common tundish functioning as a common distributing vessel for supplying melt to said at least two mould cavities, an outflow opening in said tundish for each one of said at least two mould cavities, a stopper for closing said outflow opening, and a casting pipe reaching from said outflow opening into the mould cavity and including a casting pipe section projecting at the outer side of said tundish, the improvement which comprises shearing means provided at each casting pipe on the outer side of said tundish, said shearing means including a shearing head and a sealing plate following upon said shearing head, and an adjustment drive for moving said shearing means from a waiting position beside said casting pipe into a closing position in which said sealing plate covers said outflow opening on simultaneous shearing off of said casting pipe section projecting at the outer side of said tundish with said shearing head.

2. An arrangement as set forth in claim 1, wherein said shearing head is made of metal and said sealing plate is made of refractory material.

3. An arrangement as set forth in claim 2, wherein said shearing head is made of steel.

4. An arrangement as set forth in claim 1, wherein said adjustment drive is designed as a pressure-medium cylinder, and a pressure-medium storing container is fastened to said tundish for receiving a pressure medium under pressure.

5. An arrangement as set forth in claim 1, wherein said adjustment drive is designed as a spring pressing said shearing means from said waiting position into said closing position, and an actuating device is provided for releasing said spring from the tensioned state in said waiting position.

* * * * *